US009133562B2

(12) United States Patent
Lee et al.

(10) Patent No.: US 9,133,562 B2
(45) Date of Patent: Sep. 15, 2015

(54) ELECTRODEPOSITION OF GRAPHENE LAYER FROM DOPED GRAPHITE

(75) Inventors: Young Kwan Lee, Seoul (KR); Mi Suk Cho, Suwon-si (KR); Su Jeong Lee, Pyeongtaek-si (KR)

(73) Assignee: Research & Business Foundation Sungkyunkwan University, Suwon-si (KR)

( * ) Notice: Subject to any disclaimer, the term of this patent is extended or adjusted under 35 U.S.C. 154(b) by 409 days.

(21) Appl. No.: 13/546,268

(22) Filed: Jul. 11, 2012

(65) Prior Publication Data

US 2013/0098768 A1 Apr. 25, 2013

(30) Foreign Application Priority Data

Jul. 12, 2011 (KR) ..... 10-2011-0068790

(51) Int. Cl.
*C25D 9/02* (2006.01)
*C25D 9/04* (2006.01)
*C25D 13/02* (2006.01)

(52) U.S. Cl.
CPC .. *C25D 9/02* (2013.01); *C25D 9/04* (2013.01); *C25D 13/02* (2013.01)

(58) Field of Classification Search
CPC ..... C25D 9/02; C01B 31/0438
USPC ..... 205/235, 317
See application file for complete search history.

(56) References Cited

U.S. PATENT DOCUMENTS

2011/0256014 A1* 10/2011 Hong et al. ..... 419/11
2012/0209013 A1* 8/2012 Bendikov et al. ..... 549/472

FOREIGN PATENT DOCUMENTS

JP 6-84520 A 3/1994
JP 2007-182357 A 7/2007
KR 10-2010-0116399 A 1/2010

OTHER PUBLICATIONS

Lee et al., "A Facile Synthetic Route for Well Defined Multilayer Films of Graphene and PEDOT via an Electrochemical Method" J. Mater. Chem. 22, pp. 1899-1903 (2012; published online Dec. 2011).*

Wu et al., "Field Emission of Single-Layer Graphene Films Prepared by Electrophoretic Deposition" Adv. Mater. 21, pp. 1756-1760 (2009).*

Zhou et al., "Solvothermal Synthesis of Homogenous Graphene Dispersion with High Concentration" Carbon 49, pp. 3920-3927 (2011).*

Gomez et al., "Graphene-Conducting Polymer Nanocomposite as Novel Electrode for Supercapacitors" J. Power Sources 196, pp. 4102-4108 (2011; publicly available online on Nov. 9, 2010).*

Liu et al., "The Application of Highly Doped Single-Layer Graphene as the Top Electrodes of Semitransparent Organic Solar Cells" ACS Nano 6(1), pp. 810-818 (2012; publicly available online Dec. 11, 2011).*

* cited by examiner

*Primary Examiner* — Bryan D. Ripa
(74) *Attorney, Agent, or Firm* — NSIP Law

(57) ABSTRACT

Provided is a method of forming a uniform graphene layer on a substrate (metal- or conductive-polymer-coated, ITO) by doping expanded graphite using various kinds of dopants (Lewis acid) to grant a positive charge thereto, dispersing the doped expanded graphite in an organic solvent using ultrasonic waves to obtain a solution in which the graphene is dispersed in the organic solvent, and electrically applying a negative voltage to the solution.

12 Claims, 4 Drawing Sheets

ELECTRODEPOSITION OF GRAPHENE LAYER FROM DOPED GRAPHITE

CROSS-REFERENCE TO RELATED APPLICATION

This application claims priority to and the benefit of Korean Patent Application No. 10-2011-0068790, filed on Jul. 12, 2011, the disclosure of which is incorporated herein by reference in its entirety.

BACKGROUND

1. Field of the Invention

The present invention relates to a method of forming a uniform graphene layer on a substrate (metal- or conductive-polymer-coated, ITO) by doping expanded graphite using various kinds of dopants (Lewis acid) to grant a positive charge thereto, dispersing the doped expanded graphite in an organic solvent using ultrasonic waves to obtain a solution in which the graphene is dispersed in the organic solvent, and electrically applying a negative voltage to the solution.

2. Discussion of Related Art

Although graphene is a material in which carbon atoms are two-dimensionally combined like graphite, unlike graphite, it is a material formed of a very thin single, double or triple layer.

It has been known that graphene is structurally and chemically stable, an excellent conductor that moves electrons about 100 times faster than silicon, and streams 100 times more currents than copper.

Such characteristics of graphene were confirmed when a method of separating graphene from graphite was discovered in 2004, and estimated characteristics were experimentally confirmed, thus stirring enthusiasm in scientists all over the world.

Graphene is formed of carbon, which is a relatively light element, to enable one or two-dimensional nano-patterns to be easily processed and characteristics of a semiconductor-conductor to be easily adjusted. Further, various chemical combinations that carbon has enable the fabrication of a wide range of function devices such as a sensor, a memory, etc.

In 2008, graphene was designated as one of the top 100 among global future technology by MIT, and currently, Korea Institute of Science & Technology Evaluation and Planning and Samsung Economic Research Institute have selected graphene-related technology as one of the top 10 among technology that will change our life within 10 years in Korea.

As previously described, despite superior electrical/mechanical/chemical properties of graphite, since a method of mass synthesis thereof has not been developed, research into actually applicable technology has been very limited.

One conventional mass synthesis technique includes mechanically pulverizing graphite to be dispersed in a solution, so that the results are formed as a thin film using a self-assembly phenomenon. This method enables synthesis at a low cost, but numerous pieces of graphene overlap, and the overlap structure causes electrical and mechanical properties thereof not to meet people's expectations.

One of the most widely used method of forming a graphene layer is "the filtration and transfer method" suggested by Lee, Jong-Hak (Adv. Mater, 2010). However, when filtering graphene in this method, a specific membrane named AAO is required, a number of processes are required, and the graphene should be transferred to a desired substrate. In this method, the graphene layer formed during a process of transferring is easily broken, and when the graphene is obtained in a powder state without transferring, a binder is required to be loaded to an electrode.

Electrodeposition from graphene oxide currently suggested by Liyun Chen (Small, 2011) has exhibited a process simpler than the transferring method, and a graphene layer directly formed on a substrate. However, an oxidation process for forming oxide may cause defects of graphene after a reduction process.

Technology for depositing graphene on a substrate and using doped graphene has been developed, as disclosed in Korean Patent Application Nos. 10-2009-0035082 (Apr. 22, 2009) and 10-2009-0035081 (Apr. 22, 2009). The disclosures and the present invention are similar to each other in that they are directed to a method of depositing graphene on a substrate using deposition, and expanded graphite and doped graphene are used to fabricate graphene. However, in the deposition method disclosed in the patent applications, deposition is performed on a substrate by spraying an aerosol, which is different from the present invention in which electrodeposition is performed. Further, doping using boron and phosphorus is performed by substituting with carbon disclosed in the above disclosures, which is different from the doping disclosed in the present invention. The disclosed patent applications are provided to deposit formed graphene on a desired substrate, not to obtain a large amount of pure graphene.

Accordingly, the present inventors have overcome the above problems, and found a method of forming graphene below by which a simple process method can be provided, graphene of a high degree of purity can be obtained, and mass production is enabled.

SUMMARY OF THE INVENTION

According to an aspect of the invention, there is provided a method of electrodepositing graphene. The method includes doping expanded graphite using a dopant, dispersing the doped expanded graphite in an organic solvent, and obtaining doped graphene dispersed in the solvent, and applying a voltage to the solvent in which the doped graphene is dispersed.

A term "graphite" used in the present invention denotes a structure in which two-dimensional plate-shaped graphene sheets in which carbon atoms are hexagonally connected are stacked.

A term "expanded graphite" used in the present invention denotes graphite that has a wider gap between graphene sheets in the graphite than that in general graphite.

Here, a dopant denotes a donor material, and includes Lewis acid. According to an exemplary embodiment of the present invention, the dopant may be one of $HNO_3$, $FeCl_3$, $H_2SO_4$, and FTS. According to a detailed exemplary embodiment of the present invention, the dopant may be $FeCl_3$.

According to a detailed exemplary embodiment of the present invention, the solvent may be an organic solvent, and preferably, may be ACN.

In the present invention, doped graphene denotes graphene doped by a dopant. The doping in the present invention is different from doping in which carbon atoms in graphene are substituted with boron or phosphorus described in the prior art section.

The doping in the present invention denotes doping caused by an interaction between dopant molecules of graphene and graphite while maintaining structures of the graphene and graphite.

According to a detailed exemplary embodiment of the present invention, the dispersion may be performed using an ultrasonic wave device.

According to a detailed exemplary embodiment of the present invention, the electrodeposition may be performed using a platinum plate as a counter electrode, PEDOT-coated gold as a working electrode, and Ag/AgCl/KCl (sat'd) as a reference electrode.

According to a detailed exemplary embodiment of the present invention, the applied voltage may be −0.5 V or lower, and preferably, a negative voltage of −1.5 V to −1.0 V.

Also, the inventors of the present invention found that the electrodeposition of graphene doped with $FeCl_3$ was performed at −1.0 V to −1.5 V, and preferably, −1.01 V in the best mode.

According to another aspect of the present invention, there is provided a method of electrodepositing graphene, including p-doping expanded graphite using a dopant, dispersing the doped expanded graphite in an organic solvent using ultrasonic waves, and obtaining doped graphene dispersed in the solvent, and applying a negative voltage to the solvent in which the doped graphene is dispersed through a substrate to be deposited.

According to a detailed exemplary embodiment of the present invention, the dopant may be one of $HNO_3$, $FeCl_3$, $H_2SO_4$, and FTS.

According to a detailed exemplary embodiment of the present invention, the dopant may be $FeCl_3$. Here, the applied voltage may be −1.0 V to −1.5 V, and preferably, −1.01 V, and here, the greatest amount of graphene may be electrodeposited for 10 minutes.

According to a still another aspect of the present invention, there is provided deposited graphene obtained by the above method.

BRIEF DESCRIPTION OF THE DRAWINGS

The above and other objects, features and advantages of the present invention will become more apparent to those of ordinary skill in the art by describing in detail exemplary embodiments thereof with reference to the accompanying drawings, in which:

FIG. 2 illustrates a Raman shift according to each dopant.

FIG. 3 is a result of observing delta frequency by scanning at a rate of 10 mV/s in a range from 0 to 2 V using a QCM in order to confirm a potential range in which each type of graphene is deposited. FIG. 4A illustrates PEDOT on gold, FIG. 4B illustrates graphene doped with $FeCl_3$, FIG. 4C illustrates graphene doped with FTS, FIG. 4D illustrates graphene doped with $HNO_3$ and FIG. 4E illustrates graphene doped with $H_2SO_4$.

DETAILED DESCRIPTION OF EXEMPLARY EMBODIMENTS

Exemplary embodiments of the present invention will be described in detail below with reference to the accompanying drawings.

Figure 1:
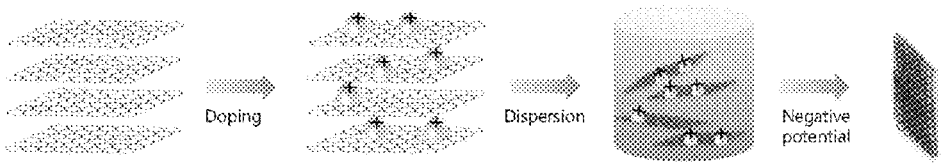
FIG. 1 schematically illustrates a method of fabricating a graphene layer using electrodeposition.
Figure 2A:
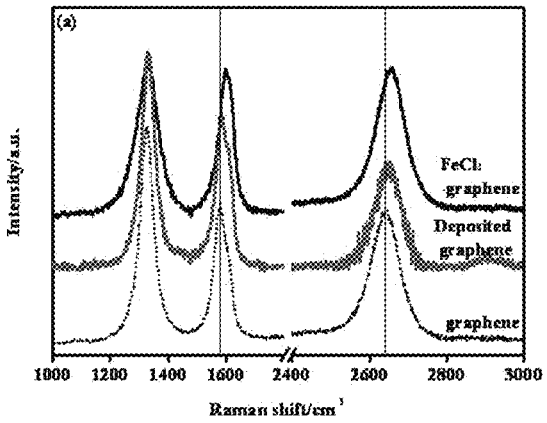
FIG. 2A illustrates a Raman shift according to a dopant of $FeCl_3$.
Figure 2B:
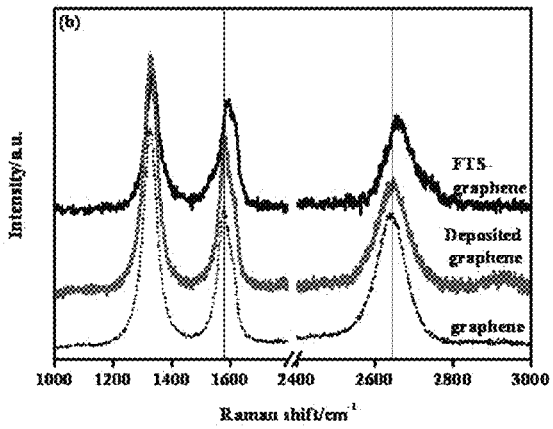
FIG. 2B illustrates the Raman shift according to a dopant of FTS.
Figure 2C:
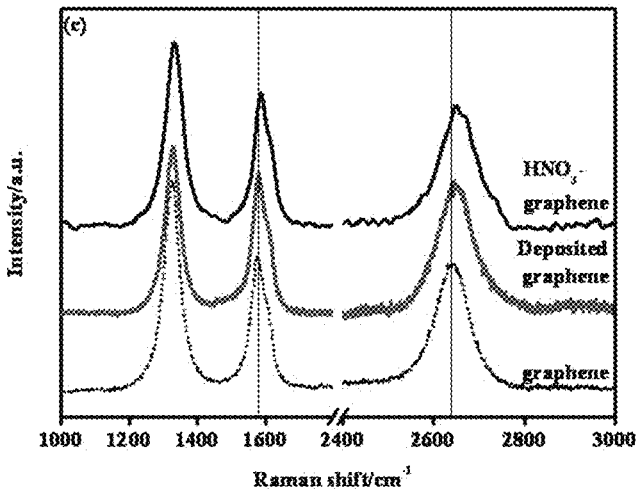
FIG. 2C illustrates a Raman shift according to a dopant of $HNO_3$.
Figure 2D:
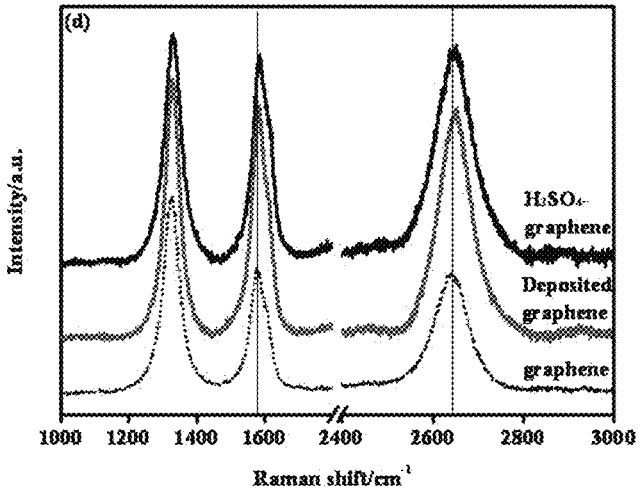
FIG. 2D illustrates a Raman shift according to a dopant of $H_2SO_4$.

FIG. 1 schematically illustrates a method of fabricating a graphene layer using electrodeposition. Expanded graphite was prepared, and was doped using a dopant such that a positive charge was granted to the expanded graphite. The results were dispersed in an organic solvent to obtain doped graphene. An electrically negative voltage was applied to the obtained results, so that a uniform graphene layer was formed on a substrate (metal- or conductive-polymer-coated, ITO).

FIG. 1A illustrates expanded graphite. FIG. 1B illustrates the expanded graphite to which positive charges are doped. FIG. IC illustrates doped graphene dispersed in an organic solvent. FIG. 1D illustrates an electrodeposited graphene layer.

The method of electrodepositing a graphene layer from doped graphite will be described in detail in the exemplary embodiments below. The embodiments below are provided to describe the present invention in detail, but are not intended to limit the scope of the invention.

EXAMPLE (1) Preparation $HNO_3$ (nitric acid, 66%, Aldrich), $FeCl_3$ (iron(III) chloride, 98%, Aldrich), $H_2SO_4$ (sulfuric acid, 99%, Aldrich), ferric(III) toluene sulfonate (FTS), and a 40% by weight solution in butanol ((Baytron CB-40), H. C. Starck) were prepared as dopants.

Acetonitrile (ACN, 98%, Junsei) was prepared as an organic solvent.

Graphite from "Zaval'evsk coal field" of the Ukraine exhibiting an ash content of <0.05 and a particle size of 200 to 300 μm was used. Graphite in which $C_2F_nClF_3$ was inserted into a plate was used as the expanded graphite. For more information on the expanded graphite, refer to "One-Step Exfoliation Synthesis of Easily Soluble Graphite and Transparent Conducting Graphene Sheets," By Jong Hak Lee, Dong Wook Shin, Victor G. Makotchenko, Albert S. Nazarov, Vladimir E. Redorov, Yu Hee Kim, Jae-Young Choi, Jong MM Kim, and Ji-Beom Yoo, "Adv. Mater." 2009, 21, 4383.

(2) Doping of Expanded Graphite

Each of $FeCl_3$ and $H_2SO_4$ was diluted into distilled water to form 12 M and 40 wt. % aqueous solutions which were used as a dopant, and FTS and $HNO_3$ were used as they were bought.

The expanded graphite and the mixture of the dopants were stirred for 20 minutes to dope the expanded graphite. Vacuum filtration was performed on the results to prepare 1 mg of solid state doped graphite.

The result of doping graphite was confirmed using a Raman spectrometer (Renishaw, Germany). Here, a laser source of the Raman spectrometer was 633 nm, which is described in detail below.

(3) Generation of Dispersed Doped Graphene 1 mg of the above obtained doped expanded graphite was added to 100 mg of ACN, and the doped expanded graphite in the ACN was dispersed for one hour using an ultrasonic wave device (750 W). As a result of this, doped graphene dispersed in the ACN was obtained.

(4) Electrodeposition of Graphene Layer

For electrodeposition of graphene, a voltammetry method was used. Here, a platinum plate was used as a counter electrode, a PEDOT-coated QCM electrode was used as a working electrode (gold, 0.28cm$^2$), and Ag/AgCl/KCl (sat'd) was used as a reference electrode.

An applied voltage was a constant voltage that varied in the range of −0.5 to −1.01 V according to a dopant.

A negative voltage (−0.5 to −1.01 V) that was a constant voltage was applied to the doped graphene dispersed in the ACN, so that a thin and uniform graphene layer was formed on the working electrode.

The obtained graphene layer was washed using distilled water to be dried by spraying nitrogen gas.

The result of the electrodeposited graphene was confirmed by Potentiostat (VSP, Princeton Applied Research, USA). The deposited amount was measured using a quartz crystal microbalance (QCM) (QCM922, Seiko Japan), which is described in detail below.

(5) Confirmation of Result

FIG. 2 illustrates a Raman shift according to each dopant. FIG. 2A illustrates a Raman shift according to a dopant of $FeCl_3$, FIG. 2B illustrates a Raman shift according to a dopant of FTS, FIG. 2C illustrates a Raman shift according to a dopant of $HNO_3$, and FIG. 2D illustrates a Raman shift according to a dopant of $H_2SO_4$.

In the p-type doping, a peak in the Raman shift is observed in a position shifted relatively to the right side. As illustrated in FIG. 2, a peak exhibited by the graphene doped by a dopant was observed in a position shifted relatively to the right side compared with the undoped graphene. That is, it was located at a high wavelength. In other words, the fact that doped graphene was obtained was demonstrated.

After deposition, i.e., while the graphene was being formed, the peak shifted relatively to the left side exhibiting a low wavelength. It was observed that the doped graphene was deposited to be reduced by an applied negative voltage, and it finally became the graphene to be formed as a layer on an electrode.

The degree of doping coincided with the degree of Raman shift. The degree of doping according to a dopant was in the order of $FeCl_3$>FTS>$HNO_3$>$H_2SO_4$.

Upon comparison of G peaks before and after doping and after deposition, all of the G peaks were maintained in a sharp state. This demonstrated that, unlike graphene formed through oxidation and reduction, the graphene was maintained in good conditions through the entire process.

The graphene after deposition was shown to be shifted to the left compared with the doped graphene. This is because the graphene doped when the negative voltage was applied during deposition was partially reduced. The following Table 1 denotes data illustrated in FIG. 2.

TABLE 1

| Dopant | Graphene (cm$^{-1}$) | p-graphene (cm$^{-1}$) | Wavelength (p-graphene − graphene) | Deposited Graphene (cm$^{-1}$) | Wavelength (Deposited-Graphene − Graphene) |
|---|---|---|---|---|---|
| $FeCl_3$ | 1578 | 1596 | +18 | 1583 | +5 |
| FTS | | 1593 | +15 | 1582 | +4 |
| $HNO_3$ | | 1587 | +9 | 1580 | +2 |
| $H_2SO_4$ | | 1584 | +6 | 1581 | +3 |

FIG. 3 is a result of observing delta frequency by scanning at a rate of 10 mV/s in a range from 0 to 2 V using a QCM in order to confirm a potential range in which each type of graphene is deposited.

Figure 3A:
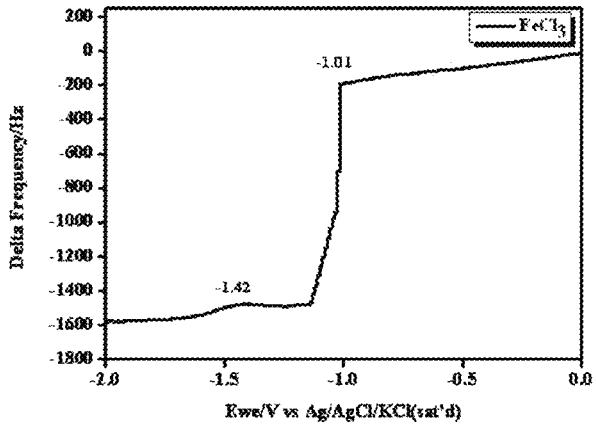
FIG. 3A is a graph illustrating a result of observing delta frequency according to a dopant of $FeCl_3$.
Figure 3B:
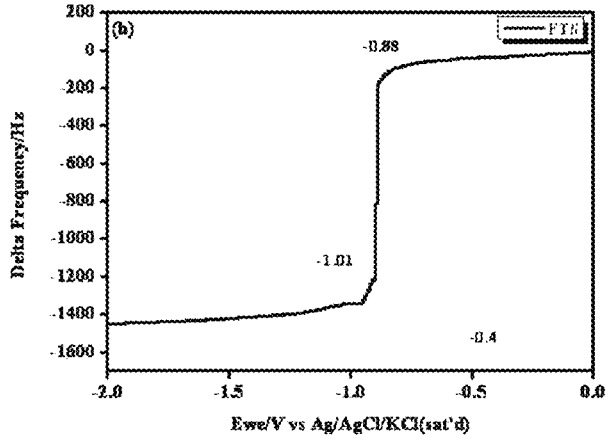
FIG. 3B is a graph illustrating a result of observing delta frequency according to a dopant of FTS.
Figure 3C:
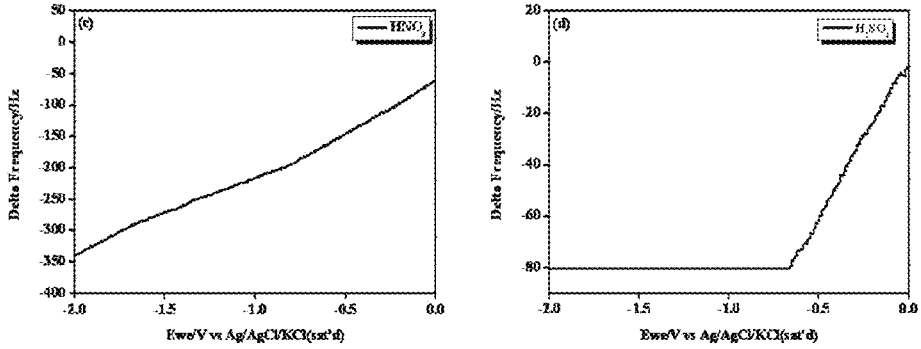
FIG. 3C is a graph illustrating a result of observing delta frequency according to a dopant of $HNO_3$.
Figure 3D:
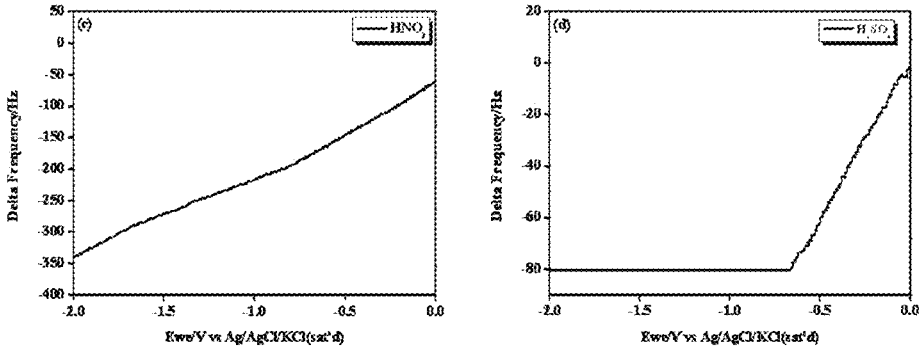
FIG. 3D is a graph illustrating a result of observing delta frequency according to a dopant of $H_2SO_4$.

FIG. 3A is a graph illustrating a result of observing delta frequency according to a dopant of $FeCl_3$, FIG. 3B is a graph illustrating a result of observing delta frequency according to a dopant of FTS. FIG. 3C is a graph illustrating a result of observing delta frequency according to a dopant of $HNO_3$, and FIG. 3D is a graph illustrating a result of observing delta frequency according to a dopant of $H_2SO_4$.

When the graphene was doped with $FeCl_3$ and FTS, it showed a significant change at a specific voltage. When the graphene was doped with $HNO_3$ and $H_2SO_4$, it was uniformly deposited through the entire field.

Also, when a positive voltage was applied to the deposited graphene, no change in frequency was shown. It was confirmed that, unlike the simple absorption, a negative voltage caused reduction and deposition to occur, so that a more stable graphene layer was formed.

Unlike the deposition performed in the negative field, when a positive potential was applied at the same scan rate in a range from 0 V to 1 V, no change in frequency occurred. It was confirmed that since the graphene, a surface of which exhibited a positive charge, was deposited by doping, deposition was performed in the negative field. The QCM data shown in FIG. 3 is indicated in the following Table 2.

TABLE 2

| Dopant | Applied Voltage | Delta Freq. (Hz) | Weight (μg) |
|---|---|---|---|
| $FeCl_3$ | −1.01 V | 1717 | 2.23 |
| FTS | −0.88 V | 1621.9 | 2.10 |
| $HNO_3$ | −1.0 V | 1312.5 | 1.70 |
| $H_2SO_4$ | −0.5 V | 336.93 | 0.43 |

Table 2 shows a change in total delta frequencies and an increase in weight thereof when the graphene was deposited for 10 minutes at a predetermined voltage based on the previous QCM data.

The total amount of deposited graphene was in the order of $FeCl_3$>FTS>$HNO_3$>$H_2SO_4$. The amount was sequentially indicated, and was consistent with the degree of doping of each type of p-graphene, which was confirmed in the Raman shift. This demonstrated that the more the doping was performed, the greater the amount of deposited graphene became during the same time.

These results confirmed that the amount of introduced positive charges was changed according to the degree of doping, and the amount of introduced positive charges was relevant to the deposition of the graphene and degree of doping.

In particular, it was observed that when the graphene was doped with $FeCl_3$, a frequency was drastically reduced at −1.2 V to −1.0 V, and more preferably, at −1.01 V. This showed that the amount of the formed graphene was great, and electrodeposition was performed thereon. Afterwards, no significant change was observed. As a result, the graphene doped with $FeCl_3$ at −1.2 V to −1.0 V, and more preferably, at −1.01 V, was deposited in the best manner.

Figure 4:
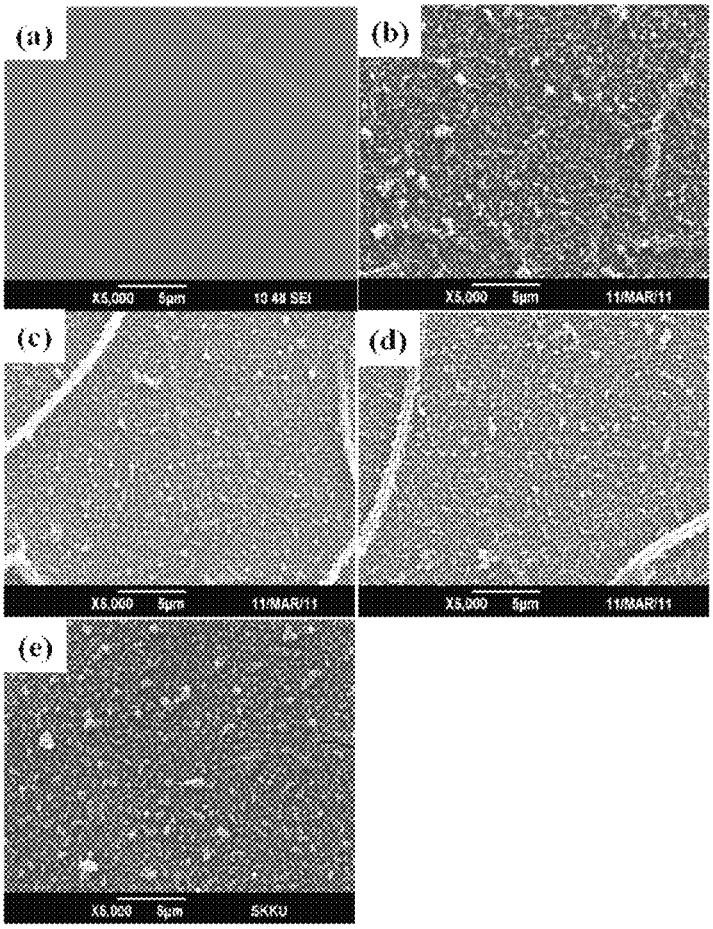
FIG. 4 illustrates scanning electron microscope (SEM) images of graphene deposited on a PEDOT/gold electrode.

FIG. 4 illustrates scanning electron microscope (SEM) images of graphene deposited on a PEDOT/gold electrode. FIG. 4A illustrates PEDOT on gold, FIG. 4B illustrates graphene doped with $FeCl_3$, FIG. 4C illustrates graphene doped with FTS, FIG. 4D illustrates graphene doped with $HNO_3$ and FIG. 4E illustrates graphene doped with $H_2SO_4$.

Unlike smooth PEDOT, a rough PEDOT surface caused by the deposition of the graphene was observed.

In general, the graphene formed by an annealing process was small (about 400 to 500 nm) and wrinkled, the rough surface after deposition was observed.

Through the method of the present invention, a large amount of pure graphene can be obtained in a very simple way.

The method of the present invention does not require a specific membrane.

The method of the present invention does not require a complicated process, and is capable of directly transferring graphene to a substrate without a binder after obtaining the graphene.

The method of the present invention enables a graphene layer to be directly formed.

The method of the present invention is directed to electrodeposition through p-doping, enables graphene to be electrodeposited, and at the same time, minimizes generation of defects.

The method of the present invention enables electrodeposition to be performed, so that a graphene layer can be prevented from breaking due to a conventional transfer method, and can be directly loaded to an electrode without a binder.

In the present invention, when graphene was doped with $FeCl_3$, the electrodeposition of the graphene was performed at −1.2 V to −1.0 V, and preferably, −1.01 V in the best mode.

It will be apparent to those skilled in the art that various modifications can be made to the above-described exemplary embodiments of the present invention without departing from the spirit or scope of the invention. Thus, it is intended that the present invention covers all such modifications provided they come within the scope of the appended claims and their equivalents.

What is claimed is:

1. A method of electrodepositing graphene, comprising:

doping expanded graphite using a dopant;

dispersing the doped expanded graphite in an organic solvent, and obtaining doped graphene dispersed in the solvent; and applying a voltage between a counter electrode and a working electrode placed within the solvent in which the doped graphene is dispersed such that a graphene coating is formed at a surface of the working electrode.

2. The method of claim 1, wherein the dopant is one of $HNO_3$, $FeCl_3$, $H_2SO_4$, and FTS.

3. The method of claim 1, wherein the dopant is $FeCl_3$.

4. The method of claim 3, wherein the applied voltage is a negative voltage of −1.5 V to −1.0 V.

5. The method of claim 1, wherein the solvent is ACN.

6. The method of claim 1, wherein the dispersing is performed using an ultrasonic wave device.

7. The method of claim 1, wherein the electrodeposition is performed using a platinum plate as the counter electrode, PEDOT-coated gold as the working electrode, and Ag/AgCl/KCl(sat'd) as a reference electrode.

8. The method of claim 1, wherein the dopant is $FeCl_3$, and the applied voltage is a negative voltage of −1.01 V.

9. A method of electrodepositing graphene, comprising:

p-doping expanded graphite using a dopant;

dispersing the doped expanded graphite in an organic solvent using ultrasonic waves, and obtaining doped graphene dispersed in the solvent;

and applying a negative voltage between a counter electrode and a working electrode placed within the solvent in which the doped graphene is dispersed such that a graphene coating is formed at a surface of the working electrode.

10. The method of claim 9, wherein the dopant is one of $HNO_3$, $FeCl_3$, $H_2SO_4$, and FTS.

11. The method of claim 10, wherein the dopant is $FeCl_3$, and the negative voltage is −0.5 V or lower.

12. The method of claim 10, wherein the dopant is FeCl3, and the negative voltage is −1.5 V to −1.0 V.

* * * * *